US008469833B1

(12) United States Patent
Schultz

(10) Patent No.: US 8,469,833 B1
(45) Date of Patent: Jun. 25, 2013

(54) BALL DIRECTING PUTTER ATTACHMENT

(76) Inventor: Arnold W. Schultz, Boynton Beach, FL (US)

( * ) Notice: Subject to any disclaimer, the term of this patent is extended or adjusted under 35 U.S.C. 154(b) by 97 days.

(21) Appl. No.: 13/161,988

(22) Filed: Jun. 16, 2011

(51) Int. Cl.
*A63B 69/36* (2006.01)
*A63B 53/04* (2006.01)

(52) U.S. Cl.
USPC ..... 473/236; 473/251; 473/330; 473/340

(58) Field of Classification Search
USPC ..... 473/325, 330, 236, 251, 340, 341; D21/736–746, 759, 791
See application file for complete search history.

(56) References Cited

U.S. PATENT DOCUMENTS

| | | | | | |
|---|---|---|---|---|---|
| 3,392,977 | A | * | 7/1968 | De Lacey | 473/306 |
| 3,881,733 | A | * | 5/1975 | Csernits | 473/330 |
| 3,989,257 | A | | 11/1976 | Barr | |
| 4,139,198 | A | * | 2/1979 | Kanavas | 473/236 |
| 4,162,074 | A | | 7/1979 | Thomson | |
| 4,290,606 | A | * | 9/1981 | Maxwell | 473/569 |
| 4,846,477 | A | * | 7/1989 | Phelan | 473/330 |
| D385,324 | S | * | 10/1997 | Ubaney | D21/759 |
| 5,782,705 | A | | 7/1998 | Solari | |
| 5,857,920 | A | * | 1/1999 | Hong | 473/240 |
| 6,045,452 | A | * | 4/2000 | Ahn et al. | 473/249 |
| D425,952 | S | * | 5/2000 | Boyer | D21/752 |
| 6,183,379 | B1 | * | 2/2001 | Kim et al. | 473/325 |
| 6,203,444 | B1 | | 3/2001 | McRae | |
| 6,270,423 | B1 | * | 8/2001 | Webb | 473/226 |
| 6,273,827 | B1 | * | 8/2001 | Hockerson et al. | 473/236 |
| 6,340,336 | B1 | | 1/2002 | Loconte | |
| D458,979 | S | | 6/2002 | Hill et al. | |
| 7,086,961 | B2 | | 8/2006 | Wright et al. | |
| 7,341,527 | B1 | | 3/2008 | Fisher | |
| 7,364,513 | B2 | | 4/2008 | Krumme | |
| 7,374,500 | B2 | | 5/2008 | Engdahl | |
| D583,888 | S | * | 12/2008 | Nehrbas | D21/759 |
| 7,648,424 | B2 | * | 1/2010 | Hinojosa | 473/236 |
| 8,162,773 | B1 | * | 4/2012 | Pingalore | 473/231 |
| D659,213 | S | * | 5/2012 | Schultz | D21/759 |
| 2004/0014533 | A1 | * | 1/2004 | Joo et al. | 473/340 |
| 2006/0094536 | A1 | * | 5/2006 | Morales | 473/342 |
| 2006/0166754 | A1 | * | 7/2006 | Kang | 473/242 |

* cited by examiner

*Primary Examiner* — Sebastiano Passaniti

(57) ABSTRACT

A ball directing putter attachment includes a panel that has a first side, a second side, an upper edge, a lower edge, a first lateral edge and a second lateral edge. The first side is concavely arcuate from the first lateral edge to the second lateral edge. A base is attached to the second side. The base is attached to a putter face.

8 Claims, 4 Drawing Sheets

BALL DIRECTING PUTTER ATTACHMENT

BACKGROUND OF THE DISCLOSURE

Field of the Disclosure

The disclosure relates to putting attachment devices and more particularly pertains to a new putting attachment device for altering the direction of a golf ball being putt to compensate for the opening or closing of a putter.

SUMMARY OF THE DISCLOSURE

An embodiment of the disclosure meets the needs presented above by generally comprising a panel that has a first side, a second side, an upper edge, a lower edge, a first lateral edge and a second lateral edge. The first side is concavely arcuate from the first lateral edge to the second lateral edge. A base is attached to the second side. The base is configured to be attached to a putter face.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
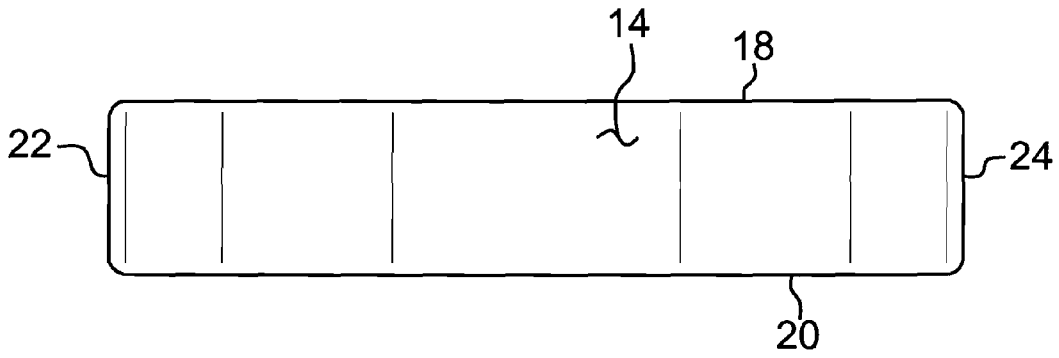
FIG. 1 is a front view of a ball directing putter attachment according to an embodiment of the disclosure.
Figure 2:
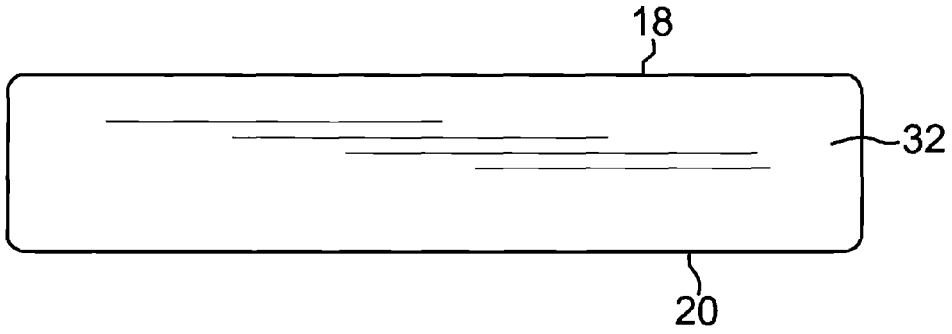
FIG. 2 is a rear view of an embodiment of the disclosure.
Figure 3:
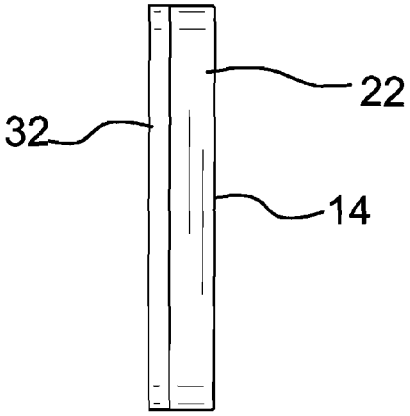
FIG. 3 is a side view of an embodiment of the disclosure.
Figure 4:
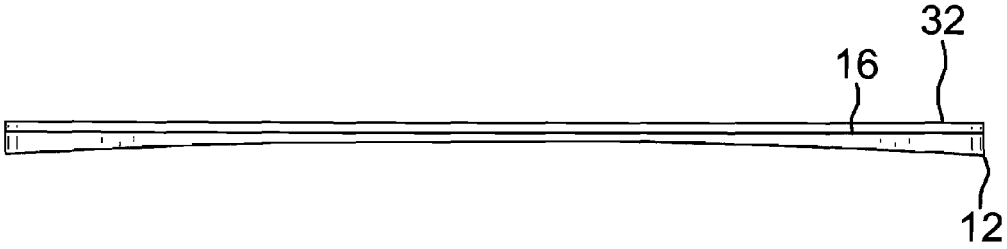
FIG. 4 is a top plan view of an embodiment of the disclosure.
Figure 5:
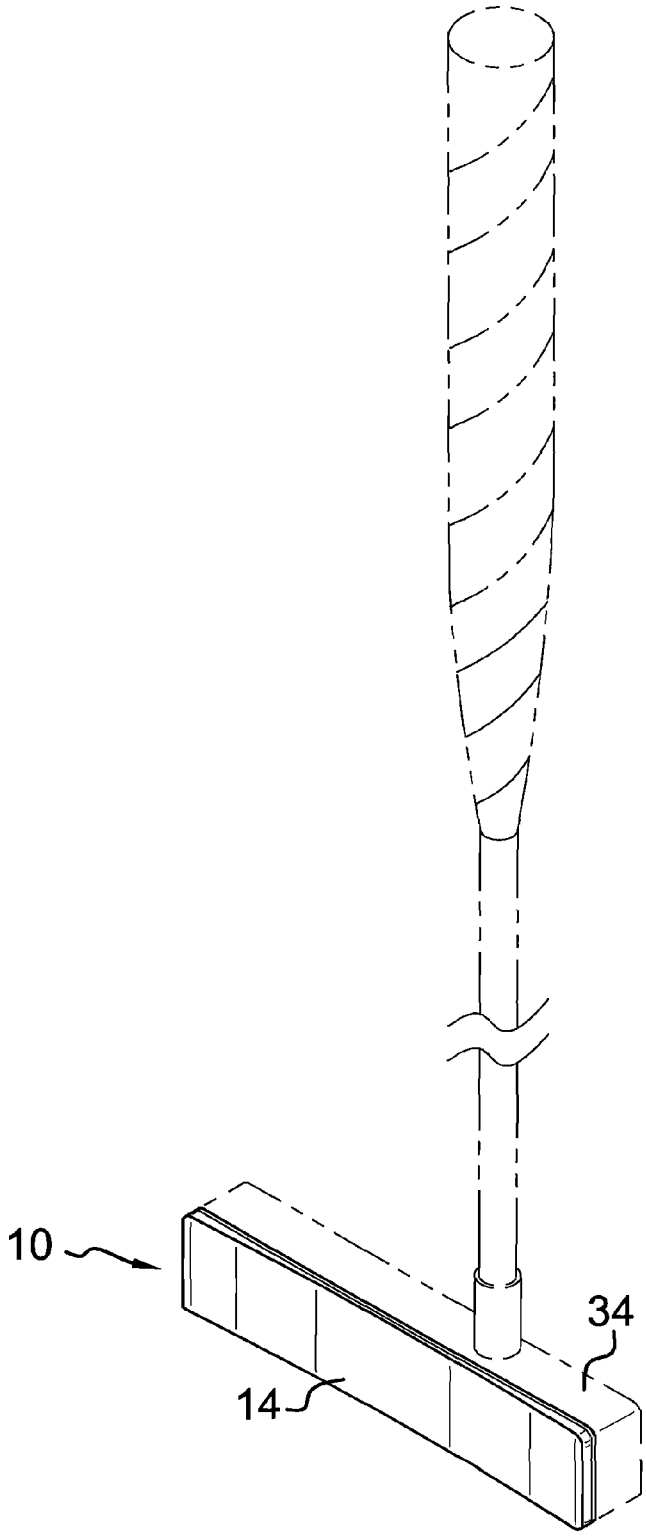
FIG. 5 is a front perspective view of an embodiment of the disclosure.
Figure 6:
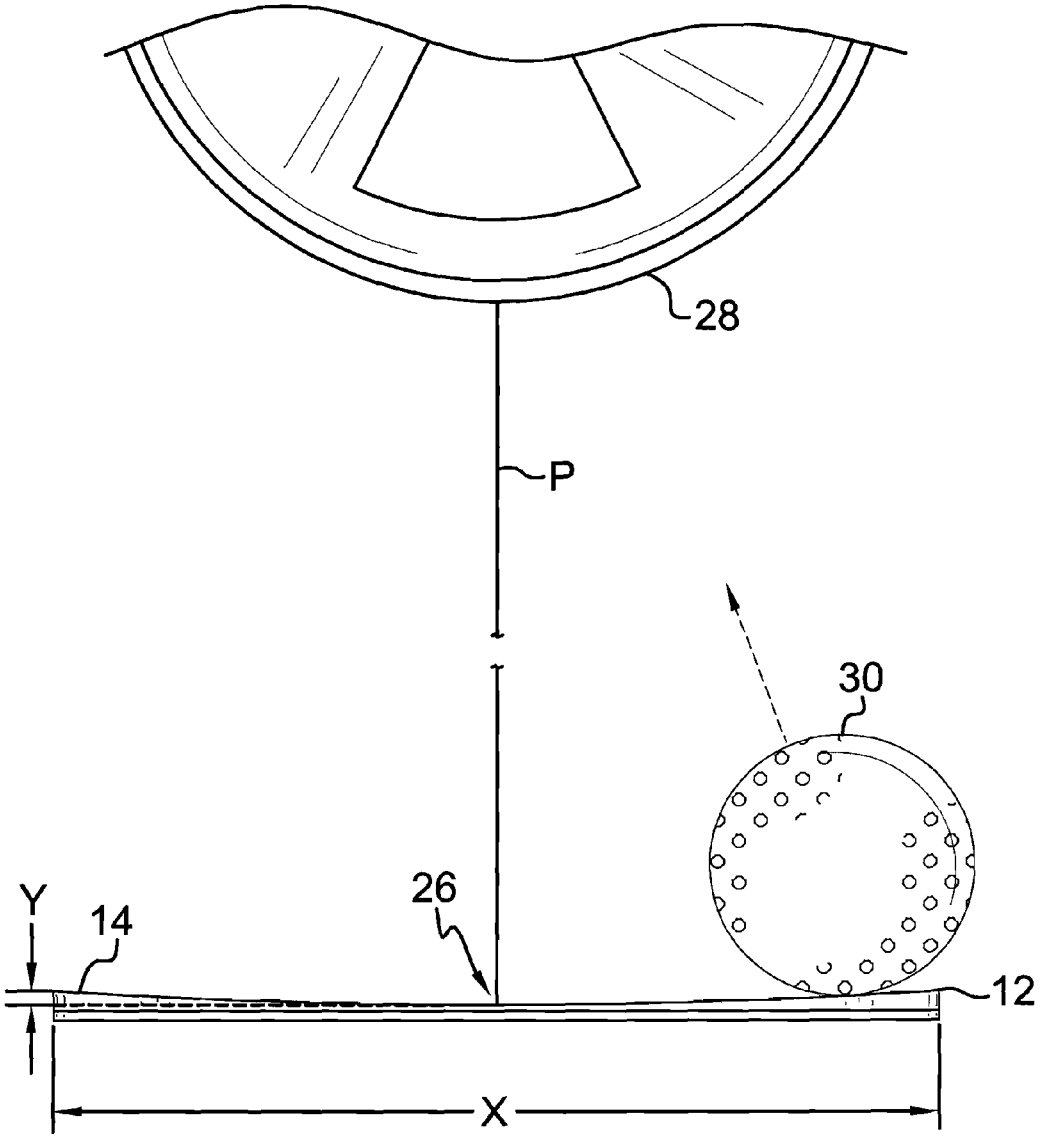
FIG. 6 is a top view of an embodiment of the disclosure.

With reference now to the drawings, and in particular to FIGS. 1 through 6 thereof, a new putting attachment device embodying the principles and concepts of an embodiment of the disclosure and generally designated by the reference numeral 10 will be described.

As best illustrated in FIGS. 1 through 6, the ball directing putter attachment 10 generally comprises a panel 12 that has a first side 14, a second side 16, an upper edge 18, a lower edge 20, a first lateral edge 22 and a second lateral edge 24. The first side 14 is concavely arcuate from the first lateral edge 22 to the second lateral edge 24. The first side 14 is curved along a parabola defined by the equation $(\frac{1}{2}X)^2=4PY$ as shown and further explained in FIG. 6.

The panel 12 has a linear width defined from the first lateral edge 22 to the second lateral edge 24 and a depth defined from the first side 14 to the second side 16. A middle point 26 is defined between the first 22 and second 24 lateral edges. The depth increases from the middle point 26 to each of the first 22 and second 24 lateral edges. Y defines a change in depth from the middle point 26 to the first lateral edge 22, X defines the width, and P defines a distance configured to be equal to a distance between the first side 12 and a golf cup 28.

The width X may be between 7.0 cm and 12.0 cm, and the panel 12 may have a height from the upper edge 18 to the lower edge 20 between 1.0 cm and 2.0 cm. It should be noted that distance P may determined depending on a distance at which a golfer has trouble making putts. Typically, this distance will be between 0.75 m and 3.0 m. Moreover, it should be understood that at distances much greater than 3.0 m, Y will have a value that will cause little to no directional impact on a golf ball 30.

A base 32 is attached to the second side 16. The base 32 is configured to be attached to a face of a putter 34. The base 32 may comprise a plastic material as may the panel 12. An adhesive may be used to removably attach the base 32 to the putter 34. It should be understood that the base 32 and the panel 12 may be integrally coupled to each other and formed of a single piece of material.

In use, the attachment 10 is coupled to the face of the putter 34 and the putter 34 used in a conventional manner. When a mishit occurs, such as when the golf ball 30 is struck away from a center point of the putter face, the curvature of the panel 12 will compensate for the putter face opening or closing due to the mishit. Thus, when the putter 34 is struck near its outside edge, the putter face will tend to open. However the curvature of the panel 12 contact the golf ball 30 at a point where it curves inward to cause the golf ball 30 to still be struck toward the golf cup 28. The opposite will occur when the putter 34 is struck near its inside edge.

The user of the attachment 10 may readily switch attachments 10 depending on the length of the putt and the degree to which the user regularly mishits a golf ball 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A putter attachment configured to be attached to a putter face to facilitate correction of a mishit putt, said attachment comprising:

a panel having a first side, a second side, an upper edge, a lower edge, a first lateral edge and a second lateral edge;

said first side being concavely arcuate from said first lateral edge to said second lateral edge; and a base being attached to said second side, an adhesive being configured to removably attach said base to a putter face; and said first side being concavely arcuate along a parabolic curve, said parabolic curve is defined by an equation represented by $(\frac{1}{2}X)^2=4PY$, wherein X is defined as a linear width of said panel from said first lateral edge to said second lateral edge and P defines a distance configured to be equal to a distance between said first side and a golf cup, said panel having a depth defined from said first side to said second side, a middle point being defined between said first and second lateral edges, said depth increasing from said middle point to each of said first and second lateral edges, Y defining a change in depth from said middle point to said first lateral edge.

2. The attachment according to claim 1, wherein said panel has a linear width from said first lateral edge to said second lateral edge between 7.0 cm and 12.0 cm.

3. The attachment according to claim 1, wherein said panel has a height from said upper edge to said lower edge between 1.0 cm and 2.0 cm.

4. A putter attachment configured to be attached to a putter face to facilitate correction of a mishit putt, said attachment comprising:

a panel having a first side, a second side, an upper edge, a lower edge, a first lateral edge and a second lateral edge;

said first side being concavely arcuate from said first lateral edge to said second lateral edge;

said panel having a linear width defined from said first lateral edge to said second lateral edge, said panel having a depth defined from said first side to said second side, a middle point being defined between said first and second lateral edges, said depth increasing from said middle point to each of said first and second lateral edges, Y defining a change in depth from said middle point to said first lateral edge, X defining said width, P defining a distance configured to be equal to a distance between said first side and a golf cup, wherein $(\frac{1}{2}X)^2=4PY$;

wherein X is between 7.0 cm and 12.0 cm and P is between 0.75 m and 3.0 m;

said panel having a height from said upper edge to said lower edge between 1.0 cm and 2.0 cm; and a base being attached to said second side, said base being configured to be attached to a putter face.

5. A ball striking system comprising:

a putter having a front face;

an attachment being removably attached to said front face, said attachment including;

a panel having a first side, a second side, an upper edge, a lower edge, a first lateral edge and a second lateral edge, said first side being concavely arcuate from said first lateral edge to said second lateral edge; and a base being removably attached to said second side;

a golf cup, said golf cup being spaced from said first side by a distance of P; and said first side being concavely arcuate along a parabolic curve, wherein said parabolic curve is defined by an equation represented by $(\frac{1}{2}X)^2=4PY$, wherein X is defined as a linear width of said panel from said first lateral edge to said second lateral edge, said panel having a depth defined from said first side to said second side, a middle point being defined between said first and second lateral edges, said depth increasing from said middle point to each of said first and second lateral edges, Y defining a change in depth from said middle point to said first lateral edge.

6. The ball striking system of claim 5, wherein said panel has a linear width from said first lateral edge to said second lateral edge between 7.0 cm and 12.0 cm.

7. The ball striking system of claim 6, wherein said panel has a height from said upper edge to said lower edge between 1.0 cm and 2.0 cm.

8. The ball striking system of claim 5, wherein said attachment is removably attached to said front face with an adhesive.

* * * * *